US007976526B2

(12) United States Patent
Kitagawa et al.

(10) Patent No.: US 7,976,526 B2
(45) Date of Patent: Jul. 12, 2011

(54) SEALED MEDICAL STORAGE

(75) Inventors: Shouichi Kitagawa, Shizuoka (JP); Yasuhiro Muramatsu, Shizuoka (JP)

(73) Assignee: Ajinomoto Co., Inc., Tokyo (JP)

( * ) Notice: Subject to any disclaimer, the term of this patent is extended or adjusted under 35 U.S.C. 154(b) by 381 days.

(21) Appl. No.: 11/621,312

(22) Filed: Jan. 9, 2007

(65) Prior Publication Data

US 2008/0033390 A1 Feb. 7, 2008

Related U.S. Application Data

(63) Continuation of application No. PCT/JP2005/012644, filed on Jul. 8, 2005.

(30) Foreign Application Priority Data

Jul. 9, 2004 (JP) ..... 2004-203655

(51) Int. Cl.
*A61B 19/00* (2006.01)

(52) U.S. Cl. ..... 604/408; 604/403

(58) Field of Classification Search ..... 604/403, 604/917, 19, 17, 408; 426/128
See application file for complete search history.

(56) References Cited

U.S. PATENT DOCUMENTS

| | | | |
|---|---|---|---|
| 2007/0060903 | A1 | 3/2007 | Miyajima et al. |
| 2007/0208320 | A1 | 9/2007 | Muramatsu et al. |
| 2008/0097372 | A1 | 4/2008 | Shimizu et al. |

FOREIGN PATENT DOCUMENTS

| | | | |
|---|---|---|---|
| JP | 2000-5275 | | 1/2000 |
| JP | 2000005275 A | * | 1/2000 |
| JP | 2002-248158 | | 3/2002 |
| JP | 2002248158 A | * | 9/2002 |
| JP | 2003-62038 | | 3/2003 |
| JP | 2003062038 A | * | 3/2003 |
| JP | 2003-159309 | | 6/2003 |
| JP | 2003-159310 | | 6/2003 |
| JP | 2005-096860 | | 4/2005 |
| JP | 2006-117586 | | 5/2006 |
| JP | 2006/175212 | | 7/2006 |

OTHER PUBLICATIONS

U.S. Appl. No. 12/512,427, filed Jul. 30, 2009, Muramatsu.
U.S. Appl. No. 12/436,172, filed May 6, 2009, Muramatsu.
U.S. Appl. No. 12/688,427, filed Jan. 15, 2010, Muramatsu, et al.

* cited by examiner

*Primary Examiner* — Tatyana Zalukaeva
*Assistant Examiner* — Benedict L Hanrahan
(74) *Attorney, Agent, or Firm* — Oblon, Spivak, McClelland, Maier & Neustadt, L.L.P.

(57) ABSTRACT

A medical bag of multi-liquid missing type for one-shot operation for opening the weak seal portion, which makes it possible to obtain simultaneous opening of a blending medicine inlet.

The medical bag 10 is formed of a soft film material and having a weak seal portion, which divides the space inside the bag into a plurality of compartments 20 and 22. A blending medicine inlet port 14 is arranged adjacent the one compartment 20. The inlet port 14 includes sealed compartments 36A, 36B and 36C for storage of the respective blending medicines. The inlet port 14 is usually closed by a peel film member 44 for preventing the blending medicines from being discharged. The peel film member 44 is strongly adhered to the opposed surface of the plastic film constructing the medical bag. An integral movement of the peelable member with respect to a widening displacement of the medial bag is obtained when the weak seal 18 is opened under a pressing force, so that the peelable member 44 is separated from the inlet port 14, resulting in a discharge of the blending medicines from the compartments 36A, 36B and 36C into the medical bag.

14 Claims, 7 Drawing Sheets

SEALED MEDICAL STORAGE

TECHNICAL FIELD

The present invention relates to a sealed medical storage, wherein it has a medical bag having compartments for storing separately medicines and a week sealed portion between the compartments, which are separated in a manner that the medicines are mixed when an intravenous dripping or dialysis et al. is done.

BACKGROUND TECHNOLOGY

As a sealed medical storage for an intravenous dripping or dialysis et al., a multi-liquid mixing type such as double liquid type has been proposed. In such a sealed medical storage of double liquid mixing type, the medical bag is formed from flexible material films and is provided with a weak seal portion, which divides or separates the space inside the medical bag into compartments for storing therein with different medical liquids. At the outer periphery of the medical bag, an outlet port for medical liquid as a thermoplastic mold product is provided, which outlet port forms as a tubular shape having an inner space, which has a first end opened to one of the compartments and a second end provided with a rubber plug. Prior to the administration of medicine to patient, the medical bag is pressed from its outside, so that the weak sealed portion is separated, so that a single chamber is created in the medical bag, causing the medical liquids to be mixed with each other. Then, a needle of an infusion set is pierced to the rubber plug, which allows the mixed medical liquids to be administered.

It sometimes is needed that additional medicines, such as vitamins or antibiotics, should be blended or mixed to the infusion liquid in a sealed medical storage. As a means for an addition of an additional medicine, a construction has been proposed, wherein an inlet port for the additional medicine is provided at a portion of the outer periphery of the medical bag opposite to the outlet port. The inlet port has a normally closed leading end, which extends into the space inside the medical bag and is opened by its breakage. Under the closed condition of the inlet port, the additional medicines are held in the space inside the inlet port. When an infusion operation is commenced, the leading end of the inlet port is broken by a manual operation from the outside of the medical bag in a manner that the inlet port is opened to the space inside the medical bag, which allows the additional medicines to be mixed with the infusion liquid. See Patent Publication No. 1.

A construction has also been proposed, wherein an inlet port for additional medicine formed as soft small bag is arranged in a medical bag and a pointed seal portion is provided for integrating the inner bag with the outer bag. A widening of the medical bag upon its separation causes the pointed seal portion to be broken, which allows the additional medicine such as vitamin to be blended.

Patent Publication No. 1: Japanese Un-Examined Patent Publication No. 2003-159309

DISCLOSURE OF THE INVENTION

Problems to be Solved

In the prior art in the Patent Publication No. 1, in order to make the inlet port to open, the leading end of the inlet port is engaged manually from the outside of the medical bag so that the inlet port is broken. As a result, two-step preparative operation prior to an infusion operation is needed, that is a separation step of the weak sealed portion and a breaking step of the leading end of the inlet port, resulting in a reduced working efficiency. Furthermore, a broken part separated from the inlet port is left in the medical bag and in the body of the medical liquid in the bag. Any harmful influence is not generated to the infusion liquid due to the fact that the broken part is left, which however makes an user to misunderstand that a kind of foreign substance is located in the infusion liquid, which should be avoided if it is possible.

In the prior art of a medical bag, where an inlet port of additional medicine of a small soft bag is provided, which is integrated with the medical bag by means of a point sealed portion, a problem may be likely that a waste of a thermoplastic film generated upon the breakage of the point sealed portion is floated in the body of the infusion liquid. In order to obviate this problem, the vitamin container may be made from a film of highly increased softness with reasonable degree of rigidity so as to provide an increased easiness in an operation for opening the vitamin container. However, so long as a principle is employed that an opening of a container is done by a breakage of a point sealed portion, a problem of waste caused by the breakage is inevitably likely. Furthermore, a selection of a material for obtaining a highly thin film cannot be done without accompanying some difficulty in a transfer of components (gradients) from the vitamin to the infusion liquid or from the infusion liquid to the vitamin. Furthermore, a control of the strength of the breakage of the soft small size bag cannot be done without accompanying difficulty.

In view of the difficulties in the prior art, the present invention aims to provide a mechanism for opening an inlet port for the blending medicines, by which mechanism one shot operation for opening the weak seal is enough to cause the inlet port to also be opened simultaneously and no waste is left.

According to the present invention, a sealed medical storage is provided, comprising: a medical bag made of a soft flexible material separated to a plurality of compartments for storing respective medicines under a sealed manner while being capable of communicated with each other; an outlet port (infusion port) for medicine facing one of said compartments and connected to the medical bag under a fluid tight manner; an inlet port (inner or small container) facing one of said compartments and connected to the medical bag under a fluid tight manner, said inlet port storing therein with at least one blending medicine separately from medicines stored in the compartments, and; closure member of said inlet port, by which the inlet port is closed with respect to the space inside the compartments of the medical bag, the closure member cooperating with an expanded deformation of the bag in a manner that the closed condition of the inlet port is cancelled by a hydraulic force as generated when the separation between the compartments is opened.

The closure member normally closes the inlet port for the blinding medicines into the space inside the medical bag. A palm of the operator presses the medical bag at its entire part in a manner that the weak seal is opened or separated and a widening of the medical bag is generated by the pressing force for opening the weak seal. At the portion of the medical bag adjacent the inlet port, an increased degree of the widening is obtained, which cooperates with the closure member so that the closed condition by the closing means is instantaneously cancelled. As a result, a communication of the inlet port with the inside space of the medical bag is obtained, which causes the blending medicine such as vitamins to be introduced into the medical bag

EFFECTS OF THE INVENTION

According to the present invention, an opening of the weak seal portion automatically initiates an introduction of a blending medicine without necessitating any additional operation, resulting in an increased efficiency in the preparative work for an infusion operation. Furthermore, a blending medicines are stored in the inlet port, which is normally closed by the closure member with respect to the space inside the medical bag and, therefore, a positive and smooth transfer of the medicines to the infusion liquid is, on one hand, obtained and, on the other hand, a production process control become to be easy. As an opening mechanism, a so-called easy peel system can be employed, by which the amount of waste as generated upon the opening by a peeling is minimized. Such peeling system is an opening system, which has popularly used system in a field of an injection medicine. Furthermore, a peel film separated from the inlet port as a vitamin container is firmly connected to the medical bag, which otherwise would be floated as a waste in the body of infusion liquid. Furthermore, the vitamin container and the peel film are separately formed, and, therefore desired separate materials are respectively selected. In other words, a variety of selection of material is realized in a manner that a protection of the contents as well as a desired function are obtained while considering various factors, such as a peeling force, adhesion property with the medical bag and an non-absorbing property of vitamins.

EXPLANATION OF REFERENCE NUMERALS

10: Medical Bag
12: Outlet Port
14: Inlet Port
15: Strong Seal Portion
16: Suspension Hole
18: Weak Seal Portion
20: First Compartment
22: Second Compartment
24: Rubber Plug
28: Communication Hole
30: Peel film
32: Holder
34: Insert Body
36A, 36B, 36C and 36D: Compartments
42: Closure Member
44: Peel film

BEST MODES FOR PRACTICING THE INVENTION

Figure 1:
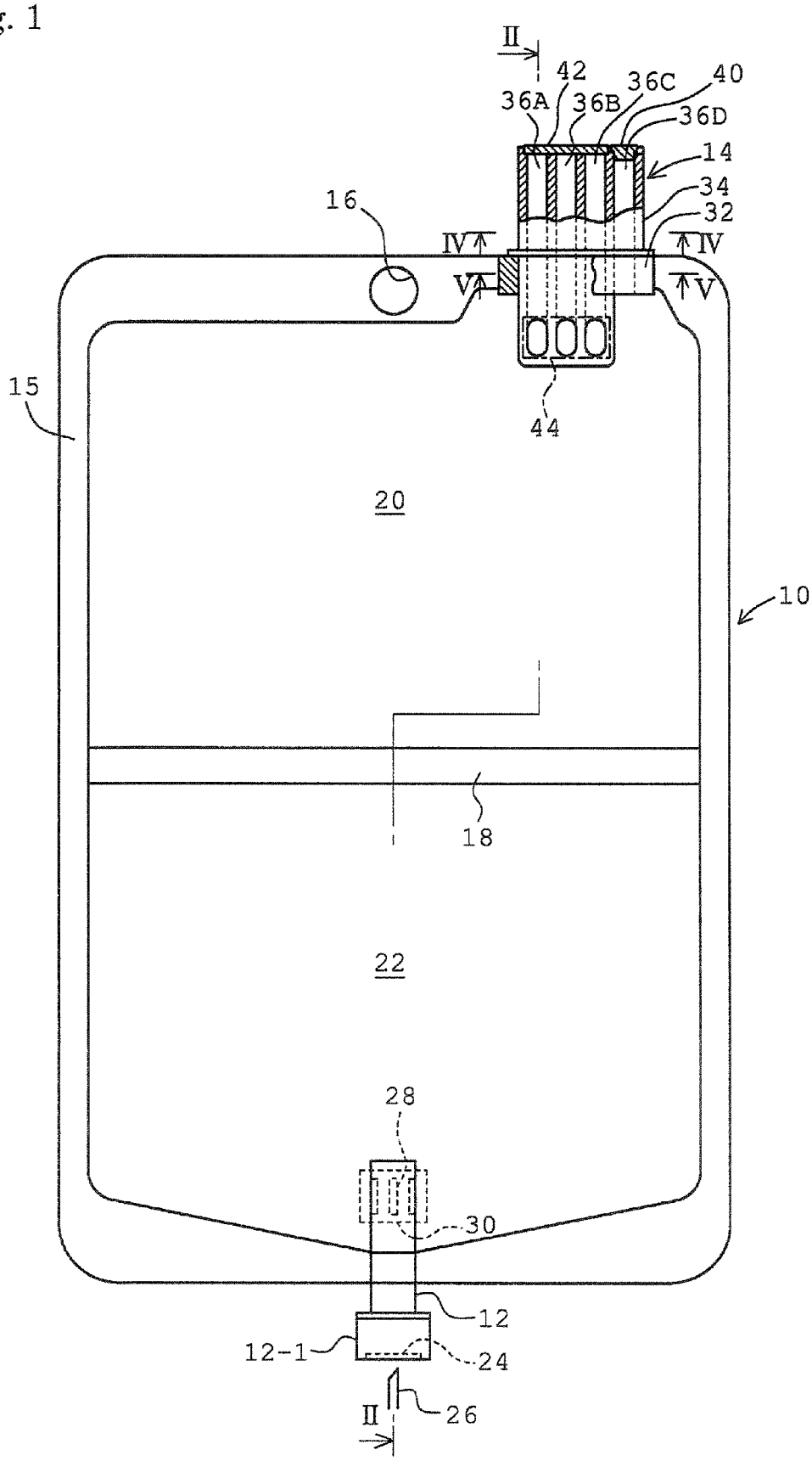
FIG. 1 is a plan view of a sealed medical storage of mixing type according to the present invention.
Figure 2:
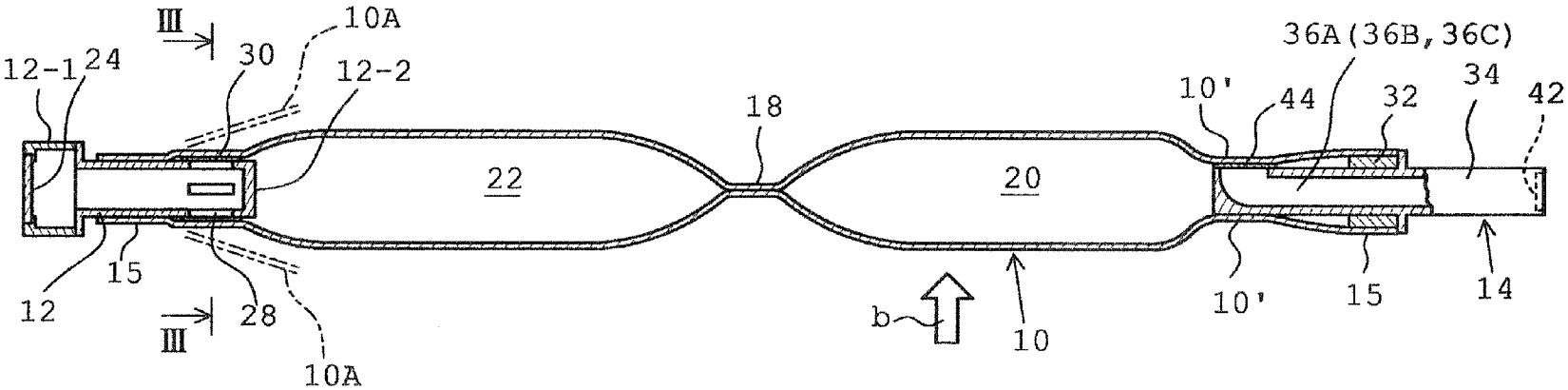
FIG. 2 is a vertical cross-sectional view of the sealed medical storage in FIG. 1 taken along the line II-II in FIG. 1.
Figure 3:
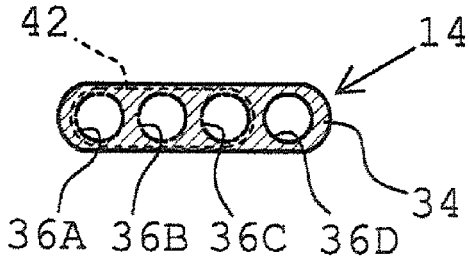
FIG. 3 is a cross-sectional taken along the line III-III in FIG. 2.

In FIGS. 1 and 2, a sealed medical storage of mixing type includes a medical bag 10 of a flat shape, an outlet port (infusion port) 12 for medicines and an inlet port (infusion port) 14 for blending medicines such as vitamins. The medical bag 10 is made of a single layered or multi-layered soft film as a flexible soft material according to the present invention, such as a polypropylene film or a polyethylene film of a thickness in a range between 200 to 400 μm. The thermoplastic films are, at the outer peripheral portions, pressed at a temperature of such as 150° C. in case of polyethylene films, which is sufficiently higher than the melting temperature, so that they are non-separably welded and a strong sealed portion 15 is obtained, thereby obtaining a bag of a rectangular shape. Formed in the strong sealed portion 15 is a suspension hole 16, by which the medical bag 10 is suspended from an instrument such as a dripping stand in a manner that the outlet port 12 is located at the bottom and the inlet port 14 at the top. Then, an infusion operation, including intravenous dripping or dialysis et al., is commenced.

At a middle portion along the length of the medical bag 10, a weak seal portion 18 extends along the entire width of the bag, by which weak seal portion 18 the front and rear layers of the medical bag are connected with each other, so that the space inside the medical bag 10 is divided into a first and second compartments 20 and 22. For an infusion purpose, the first compartment 20 stores the first medical liquid, which is glucose, dissolved in an acid solution of a value of pH in a range between 3 and 5 together with an electrolyte component, such as a calcii chloride. The second compartment 22 stores a second medical liquid, which is a solution of a value of pH in a range between 6 and 8 including various amino acids. The weak seal portion 18 is formed by pressing the top and bottom layers of the polyethylene films constructing the medical bag 10 at a low temperature, such as 130° C., which is slightly higher than the softening temperature of the polyethylene. As a result, the weak seal 15 is separated while the strong seal 15 is kept closed, when the medical liquid stored in the medical bag 10 at the location of the compartment 20 or 22 is outwardly pressed, so that the first and second medical liquids are mixed with each other.

The medical bag 10 may be formed from a single or multi-layered soft film. Furthermore, it is conventional that the medical bag for an infusion having inner small container (inlet port) and storing therein with an amino-acid or glucose as in the present invention is provided with a deoxidant and is constructed by a multi-layered film, on which a film of an oxygen barrier capacity is adhered and laminated, so that a function for preventing degeneration of the amino-acid is obtained. Furthermore, a wrapping under an existence of an inactive gas is desirably done. A known deoxidant, which includes, as an effective component, ferrous compound, such as iron hydroxide, ferric oxide or iron-carbide, may be used. An article available in the market under a trade name of "Age Less" by Mitsubishi Gas Chemical Company, Inc. may also be used.

As for a film having the oxygen barrier function, a transparent one may be used, such as an EVOH film, MXD nylon film, silica deposition film, alumina deposition film, silica-alumina combined deposition film, polyvinylidene chloride coated film, PVA coated film or EVOH-nylon combined extruded film. As an alternative, a foil or film having a light shading function such as a metal deposition film, such as aluminum foil or aluminum deposition film can be used.

As for wrapping material for the medical bag 10, it is important that a stability of the medicines (drugs) stored in the small container (inlet port 14) is taken into a consideration. Namely, in case where vitamins are stored in the small sized container (inlet port 12), it is desirable that a laminated film, having an oxygen barrier function, a moisture evaporation function and a light shading function is used. In a production of a film obtaining these functions, a film painted by using a shading ink, a film having an oxygen barrier function, a polyolefin film having a capability of heat welding, et al. are sequentially laminated by using adhesive. In order to obtain the shading function, in addition to the laminated film using the above-mentioned shading ink, a single layered film incorporated with a shading material, such as a carbon or a multi-layered film made by T-die film forming method and incorporated with a carbon may be used.

Furthermore, as a multi-layer film, the one having an intermediate layer as a metallic foil or a film having a metal deposition film may be used, so that a shading function and an oxygen barrier function are simultaneously obtained.

Figure 5:
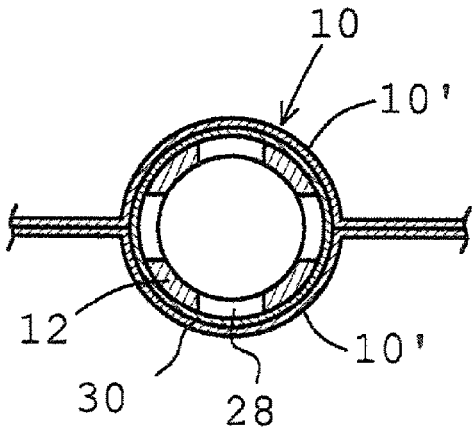
FIG. 5 is a cross-sectional taken along the line V-V in FIG. 1.

The outlet port 12 has a rigidity, which is large enough to keep its shape and is a mold product of a thermoplastic material, such as ethylene, polypropylene or polyolefin. It is desirable that the outlet port 12 is made of the same type of thermoplastic material as that of the medical bag, which allows the outlet port to be effectively adhered to the medical bag 10. As shown in FIG. 2, the outlet port 12 is, at its one end (outer end), formed with an enlarged diameter portion, which is constructed by a separately formed cap 12-1. The cap 12-1 has an opened end fitted by a rubber plug 24, to which a needle 26 of an infusion set is pierced. The outlet port 12 is, at its other end (inner end), formed with a closed end wall and is formed with a peripheral wall having a plurality of circumferentially spaced communication holes (radial holes) 28 as shown in FIG. 5. During an infusion operation by the infusion set, a medical fluid in the bag 10 is flown into the outlet port 12 via the communication holes 28. As will be explained later, a peel member 30 as a cut of plastic film is subjected to a welding at a low temperature to the communication holes 28, so that the holes 28 are normally closed and is separated simultaneously with the opening (separation of opposed films) of the medical bag 10. The peel film 30 keeps a condition that the outlet port 12 is closed with respect to the space inside the medical bag until the opening of the weak seal portion 18. Thus, the medical liquid in the medical bag 10 is prevented from being discharged even if piercing of the rubber plug 24 is done. As a result, an erroneous operation, that intravenous dripping operation is done without mixing, is prevented.

Figure 4:
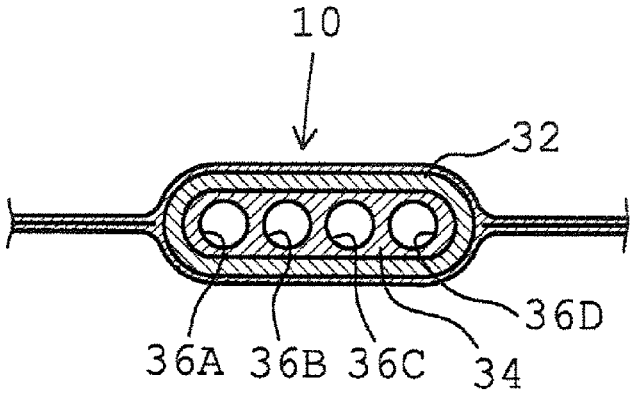
FIG. 4 is a cross-sectional taken along the line IV-IV in FIG. 1.

In FIG. 1, the inlet port (small container) 14 for blending medicines is formed as a thermoplastic container of rigidity, which is large enough to keep its shape. In this embodiment, the inlet port 14 is arranged so as to face the upper compartment 20 and stores, under a sealed condition, blending medicines, such as, water-soluble vitamins such as vitamin B1, vitamin B2, vitamin B6, vitamin B8 and vitamin B12, fat-soluble vitamins, such as, vitamin E and vitamin D, peptic ulcer drugs and antibiotics. These blending medicines are introduced into the infusion liquid when the double liquid bag 10 is made open. The inlet port 14 has an annular holder 32 and an inner body 34, which is made integral with respect to the holder 32 by an insert molding. The holder 32 and the body 34 are thermoplastic mold parts having a suitable rigidity, which makes them to maintain their shapes as similar to the outlet port 12. The holder 32 is made from a thermoplastic resin of the same type as that of the medical bag 10, such as polyethylene, so that the holder member 32 is effectively adhered to the medical bag 10. The inner body 34, which is integrated with the outer holder by the insertion molding, is also thermoplastic mold part and is preferably formed from cycloolefin polymer, in a manner that a reduced absorption property is obtained with respect to the blending medicines, such as vitamins, stored in the small container 14. In addition, two-color molding may be employed in a manner that only liquid contacting portion is formed of the cycloolefin and the outer portion is formed of a thermoplastic material of the same type as that of the holder 32, which solution is advantageous in view point of the weldability to the holder 32. In this embodiment, the insert body 34 is formed with four separated chambers 36A, 36B, 36C and 36D (FIGS. 4 and 5). The first three chambers 36A, 36B and 36C are for storing desired vitamins, respectively. The forth chamber 36D, which is for a co-infusion of different medicine, includes a bottom end opened to the bag and a top end closed by a rubber plug 40 for piercing.

Now, a construction for obtaining a sealed structure of the three chambers 36A, 36B and 36C will be explained. Namely, the chambers 36A, 36B and 36C pass through the insert body 34 and have first ends located outside the bag and fitted with a plug 42 and second ends located inside the bag, to which second ends a peel film 44 is welded, so that blending medicines are respectively stored in the chambers 36A, 36B and 36C under a sealed condition. The peel film 44 is formed by a thermoplastic film, such as multi-layered film including an outer layer made of polyethylene and an inner layer made of cyclopolyolefin and has a thickness in a range of 0.02 to 0.5 mm and preferably in a range of 0.04 to 0.4 mm. In the similar way as the peel film 30 closing the communication holes 28 of the outlet port 12, the peel film 44 is welded separably to the inlet port 14 in order to obtain sealed structure of the chambers 36A, 36B and 36C, so that a communication with the inner space of the medical bag 10 is prevented. The peel film functions as a closure member of the inlet port. However, as an alternative of the peel film, the inner end of the inlet port may be connected to the opposed inner surface of the medical bag 10 by an adhesive in a manner that the adhered part of the medical bag 10 as a closure member is peelable.

The welding of the peel film 44 is done at a low temperature to provide a strength, by which peel film 44 is able to keep a closure of the compartments 36A, 36B and 36C during the usual stored condition, on one hand and, on the other hand, the peel film 44 is easily peeled under an outside force. In case of polyethylene, the welding temperature is about 130° C., which is slightly higher than its softening temperature of polyethylene constructing the medical bag 10, i.e., is equal to the welding temperature for forming the weak seal portion 18. The seal film 44 is, at its outer surface, strongly welded to the opposed portion 10' of the medical bag 10 as shown in FIG. 2. The welding of the peel film 44 and the portion 10' of the bag is strong enough so that a separation does not occur by an externally applied force and is at a temperature of about 150 ° C., which is equal to the welding temperature for forming the strong seal portion 15. Under a normal condition of the medical bag 10, the peel film 44, which is, at its outer surface, fixedly connected to the opposed surface of the bag 10, seals and closes the compartments 36A, 36B and 36C. Namely, the peel film 44 adhered to the opposed surface of the medical bag constructs closure member of the present invention. The peel film 44 fixedly connected to the medical bag 10 is subjected to an integrated displacement with the widening of the medical bag as obtained when it is opened, so that the peel film 44 is separated from the inlet port 14, thereby causing the compartments 36A, 36B and 36C to be opened. As a result, the medicines in the compartments 36A, 36B and 36C are respectively introduced into and mixed with the infusion liquid in the medical bag 10.

In practicing the present invention, the blending medicine inlet 14 and the plug 24 may be produced by any existing method, including a conventional one, such as an injection molding or a machining. The injection molding is preferable from the viewpoint of a mass production and a commercialization. The holder 32, which connects the inlet port 14 to the medical bag 10 is concerned, may be integrally formed by a two color molding or insertion molding, et al. Furthermore, the holder may be provided with a flange along its outer periphery, which flange is integrated by an ultrasonic welding or thermal welding or press fitting. In a press fitted and welded construction of the holder 32, any non-limitative existing method may be employed, although an injection molding or machining may be advantageously employed. In addition, from the viewpoint of mass production, the injection molding may be desirably employed. Furthermore, the sealed medical storage according to the present invention is provided with a co-infusion port 36D for a co-infusion. Although non-limitative, the co-infusion port 36D may advantageously be produced under a simultaneous injection molding method, when the same material as that of the container is used or under an insert molding method when a different material is used. As an alternative, the co-infusion port may be separately formed by using a method such as injection molding, which is provided with a portion such as flange portion for a fixation under an ultrasonic welding or a heat welding. The co-infusion port 36D is provided with a rubber plug 40 for a purpose of a liquid seal or for a piercing by a needle. The rubber plug is not limited in its material, which is, however, generally a butyl rubber or isoprene rubber, which may be fixed by a press fitting. As an alternative, the plug 40 is made of a heat thermoplastic elastomer rubber, such as styrene-based elastomer, olefin based elastomer, ester based elastomer or nylon-based elastomer, the fixation of which may be done under an insertion molding. Furthermore, a rubber plug with a flange may be produced by an insertion molding et al, which is fixed to the co-infusion port by a method such as ultrasonic welding or heat welding.

The closure of the blending drug inlet port 14 for storing vitamins et al is realized by welding, such as a weak seal or a welding by a seal member of easily peelable nature. A method of production of the peel seal is generally realized by T-die molding, inflation molding or injection molding et al, although not to be limitative. From the viewpoint of mass-production, T-die molding is preferable. The welding is worked by an ultrasonic welding or heat welding et al.

The holder 32 and the insert body 34 constructing the inlet port (inner small container) 14 and the plug 40 may be constructed by one or more rigid or quasi-rigid thermoplastic materials of desired easiness of molding under a method such as an injection molding, such as polyethylene, polypropylene, cyclopolyolefin, polystyrene, polyethylene terephthalate or polycarbonate. However, when vitamins as small amount medicines should be stored, a low absorption is needed, which makes the material such as cyclopolyolefin to be preferable. Furthermore, as far as the container 14 and the plug member 40 are concerned, in addition to a reduced moisture adsorption, increased degrees of impact resistance as well as an adherence to the holder member 32 are required. In view of this, a multi-layer structure of different materials may be obtained by employing a two-color molding, wherein the layer contacting the liquid (inner layer) is formed of a material such as cycloolefin and the outer layer is formed of a material such as polyethylene. The holder member 32 and the insert body 34 may be formed from one or more rigid or quasi-rigid thermoplastic materials of desired easiness of molding under a method such as an injection molding, such as polyethylene, polypropylene, cyclopolyolefin, polystyrene, polyethylene terephthalate or polycarbonate. However, from the viewpoint of a fixing performance with the container and the fixing performance with the medical bag, a material such as cycloolefin, polyethylene or polypropylene is preferable. Furthermore, as far as the holder is concerned, in order to obtain an increased fixation strength to the medical bag, two-color molding method may be employed to obtain multi-layer structure of different materials, wherein the inner layer (surface connected to the container) is formed of a material such as cycloolefin and the outer layer (surface connected to the medical bag) is formed of a material such as polyethylene.

Furthermore, the peel film (closure member) may be formed from one or more thermoplastic materials, such as polyolefin, polybutadiene or ethylene-vinyl acetate copolymer. Furthermore, an adulterant for weak seal function, such as a styrene-based elastomer, olefin based elastomer, polyester based elastomer or nylon based elastomer may be added. In order to obtain increased adherence strength to the medical bag as well as an effective function as a weak seal, a medical bag made of polyethylene and a blending drug container made of cycloolefin may be used although being non-limitative. In this case, (1) the polyethylene and the cycloolefin may be used under non-mixed or mixed condition and an addition of elastomer based rubber component as an adulterant for the strength of adherence may be done. (2) A laminated film structure of two or more layers may be employed, wherein the outermost layer is constructed by polyethylene and the inner most layer is constructed by cycloolefin. Such a laminated structure is not limitative and a number of laminated layers more than two may be employed. In this case, each of layers may be constructed by a single type of resin or plurality types of resins, which are blended. Furthermore, an elastomer based rubber component as an adulterant for the strength of adherence may be added.

The inlet port 14 according to the present invention as a container for small amount drugs such as vitamins may be produced by a method such as an injection molding or a machining. For a purpose of addition of a small amount of drugs, the inlet port 14 is formed so as to store one or more drugs of a volume, preferably, in a range between 0.5 and 5 mL and, more preferably, in a range between 1 and 3 mL, although non-limitative.

In consideration of various factors such as ingredient movement between the small amount drugs and the infusion liquid, an evaporation of moisture component from the small amount drugs and a damage of the container, the inlet port 14 according to the present invention as a container for small amount drugs is formed to have a wall thickness, preferably, in a range between 0.5 and 4 mm and, more preferably, in a range between 0.8 and 3 mm, although being non-limitative.

In an embodiment according to the present invention, the inlet port 14 is tightly closed by means of the plug member 40. However, in order to obtain a tight closure, a fixedly integrated structure may be obtained by a method such as an ultrasonic welding or heat welding or a fitting may be employed for obtaining an integrated structure.

Prior to storing vitamins et al to the container 14, it may possible that a replacement of the inside air to nitrogen gas is done. However, a closure of the container by a plug may be done without such a replacement.

In order to obtain amounting, the small container (inlet port) 14 is, under a condition charged with the respective medicines, first connected to the medical bag, which is, then, charged with the medical liquids, although being non-limitative.

The peel member 30 normally closing the communication ports 28 of the outlet port 12 is, at the side welded to the medical bag 10, made from the same type of plastic material as that constructing the medical bag and, at the side welded to the outlet port 12, made from the plastic material, which allows the peel strength to be adjustable. The peel member 30 is, for example, formed from a multi-layer film having an inner side made of polyethylene and an outer side made of olefin copolymer. The peel member 30 is welded to the opposed plastic film constructing the medical bag 10 at a low temperature.

The sealed storage as shown in FIG. 1 is produced by the following method, although not limitative. A medical bag is prepared, wherein its inner space is divided into the compartments 20 and 22 by the weak seal portion 18 and the strong seal portion 15 is formed along the outer periphery except at an opening adjacent the compartment 22 for the installation of the inlet port 14 and an opening adjacent the compartment 20 for the installation of the outlet port 12. The compartments 20 and 22 are for filling with respective medical liquids via respective openings. A mounting of the inlet port 14 for blending medicines is done via the respective opening and closed by the strong seal portion 15. The detail of the strong seal at the inlet port 14 will be explained. Namely, prior to the mounting to the medical bag, a low temperature welding of the peel film 44 to the inlet port 14 is done. As a result, the inside space of the inlet port 14 fitted properly with the closure member 42 as well as the rubber plug 40 is under a tightly closed condition by the peel film 44, which is peelable. The inlet port 14 with the peel film 44 is inserted to the opening to the compartment 20 and a high temperature welding is done, simultaneously with the welding between the medical bag 10 and the peel film 44. Namely, a die set for the welding is provided with a first welding part for obtaining a press contact of the plastic film 10' constructing the medical bag 10 to the entire periphery of the annular holder member 32 of the inlet port 14 and a second welding part integrally extending from the first welding part. As a result, simultaneously with a formation of a strong seal portion 15 by a welding of the plastic film 10' constructing the medical bag to the annular holder 32 of the inlet port 14, a high temperature welding of the plastic film 10' constructing the medical bag 10 to the peel film 44 is done.

Furthermore, a strong seal at the installation opening for the outlet port 12 at the location adjacent the compartment 22 is done in a similar way. Namely, the outlet port 12 is inserted to the opening to the compartment 22 and a die set effects a high temperature welding, so that the strong sealed portion 15 is created on one hand and, on the other hand, the inner surface of the plastic film constructing the medical bag is welded at a high temperature to the outer surface of the peel film 30, which is welded to the outer side of the communication holes 28.

FIG. 2 illustrates a condition of the medical bag 10, where the compartments 20 and 22 are filled with the respective medical liquids and the weak seal portion 18 is non-opened. Namely, the medical liquids are respectively stored in the compartments 20 and 22 and the medical bag 10 is under a slightly inflated condition at the degree corresponding to the amount of the medical liquids in the compartments 20 and 22. However, the peel film 44 closes the compartments 36A, 36B and 36C, in a manner that the respective blending medicines are separately stored in the compartments 36A, 36B and 36C. Furthermore, the peel film 30 closes the communication openings 28 at the outlet port 12. As a result, the medical liquid in the medical bag is prevented from being discharged from the outlet port 12 even in a situation that the rubber plug 24 (FIG. 1) is, by a mistake, pierced by a needle 26 of an infusion set.

Figure 6:
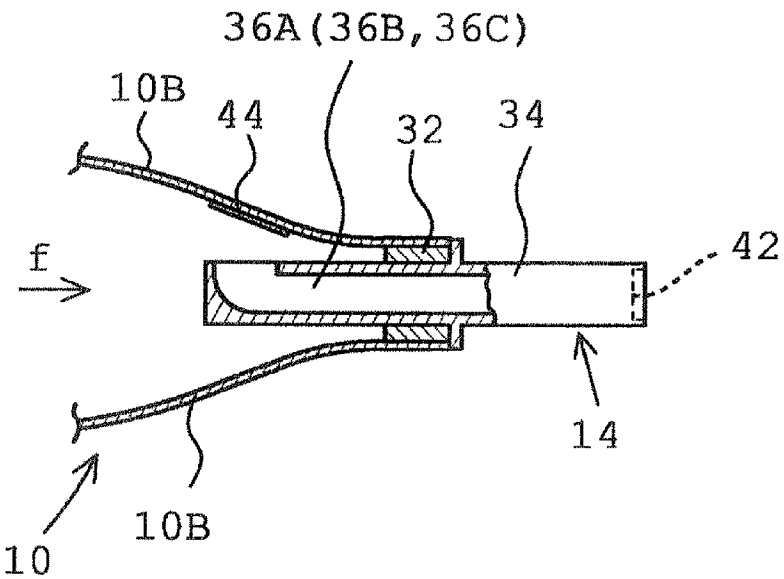
FIG. 6 is a partial view of the sealed medical storage in FIG. 1 and illustrates a condition of a portion of a medical bag connected to a blending medicine inlet port at the instance of the opening of the medical bag.

In order to make the medical bag 10 to be opened (medical liquids to be mixed), the medical bag 10 is strongly pressed from the above by a palm of an operator as shown by an arrow b in FIG. 2. FIG. 2 shows that the bag is pressed at the portion of the compartment 20. As an alternative, the pressing may be done on the side of the compartment 22 or on both sides of the compartments 20 and 22. Due to the pressing of the medical bag 10, an inner hydraulic pressure is generated, which causes the weak seal 18 to be instantly separated and opened. The increased inner pressure in the medical bag 10 due to its pressing also causes the bag 10 to be highly expanded. In FIG. 6, the hydraulic pressure generated in the bag 10 and directed to the blending drug inlet port 14 is shown schematically by an arrow f. Due to the hydraulic pressure f generated in the bag 10 when the weak seal portion 18 is separated, the plastic film 10A constructing the bag 10 is spread or widened, so that the seal film 44 firmly adhered to the medical bag is outwardly displaced together with the medical bag 10, on one hand and, on the other hand, peeled or separated from the inlet port 14, because the degree of the adherence of the seal film 44 to the inlet port 14 is weak. The separation of the seal film 44 from the inlet port 14 causes the space inside the bag 10 to be permanently connected to the compartments 36A, 36B and 36C. Thus, an introduction of the blending medicines in the compartments 36A, 36B and 36C is obtained.

The rushing flow of the medical liquid in the medical bag 10 generated upon the separation or opening of the weak seal portion 18 is also directed to the outlet port 12, so that the medical bag 10 is spread or widened as shown by a phantom line 10A in FIG. 2. Thus, the seal film 30 integrally fixed to the medical bag 10 is separated or broken from the outlet port 12, so that the communication ports 28 are opened. As a result, the inner space of the medical bag 10 is opened to the inner space of the outlet port 12 via the communication ports 28. Therefore, an infusion is commenced upon the piercing of the rubber plug 24 by the needle 26 of the infusion set 26 (FIG. 1).

The fourth compartment 36D in the inlet port 14 is for piercing so that a co-infusion of an additional medical liquid into the medical bag is done. Namely, the rubber plug 40 is pierced by a needle connected to a separate container (not shown), so that a dripping of additional medical liquid into the medical bag 10 is commenced.

In the above embodiment, in order to obtain a communication of the outlet port 12 as well as the inlet port 14 to the inner space of the medial bag 10, a welding of the seal films 30 and 44 is done in a manner that they are separated or broken under a cooperation with the expanded displacement of the medical bag upon the opening of the weak sealed portion 18. However, in place of the welding, an adhesive may be employed, which makes the seal films 30 and 44 to be desirably separated.

Figure 7:
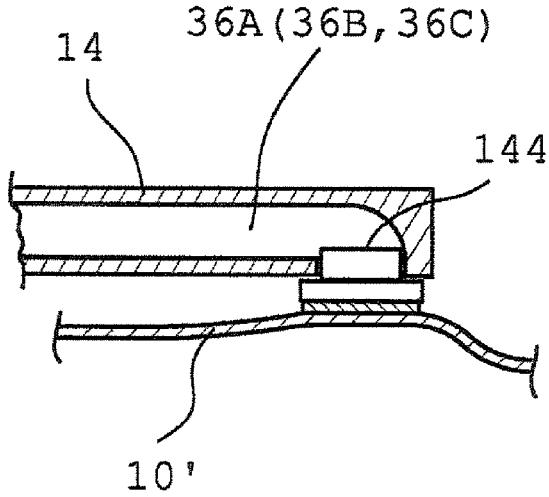
FIG. 7 shows another modification of a separable closure member closing an inner small container.

FIG. 7 shows a modification of a closure member, which is made integral to the inlet port 14 and is separable. Namely, in this embodiment, a rubber cap 144 is fitted to the compartments 36A, 36B and 36C. The rubber cap 144 is, at its outer surface, strongly welded to the film 10' constructing the medical bag 10. When the medical bag 10 is opened, the expansion of the medical bag is generated, which causes the rubber cap 144 to be disengaged from the container 14, thereby allowing the vitamins to be flown out. Since the rubber cap 144 is strongly welded to the film 10', the rubber cap 144 maintains a fixed state to the medical bag. Thus, the rubber cap 144 is prevented from being floated in the medical liquid, on one hand, and, on the other hand, a no waste is generated, since the opening is done under a principle other than the breakage.

In the embodiment, the rubber cap 144 may be made of a rubber or thermoplastic elastomer-rubber soft material, which is suitable for obtaining a sealed fitting structure, such as a natural rubber, butyl rubber or isoprene rubber. However, more preferably, a thermoplastic elastomer, such as polyethylene may be used in order to obtain an increased degree of the adherence with respect to the medical bag of increased softness.

Furthermore, in order to obtain an increased degree of the adherence with respect to the medical bag made of a material such as polyethylene, a closure plug of integrally molded structure may be preferably employed, wherein a flange member made of the material, which is identical to that for obtaining the medical bag, is integrally molded with respect to a thermoplastic elastomer-rubber plug.

A method for obtaining a strong welded structure between the medical bag and the rubber plug is non-limitative. However, an ultrasonic or thermal welding may be preferably employed.

In the above first embodiment, a breakage of the peel films 30 and 44 are done simultaneously with the separation of the weak seal portion 18 for mixing the two liquids, which is advantageous in that both of the mixing of the two liquid upon the opening of the medical bag and introduction of the blending medicines are positively obtained, thereby positively preventing an erroneous operation from being occurred, that, without the mixing of the liquids, just one liquid is administered while introducing the blending medicines.

Furthermore, in the first embodiment, the inlet port 14 is integrally provided with, in addition to the first, second and third compartments 36A, 36B and 36C for the respective blending medicines, a fourth compartment 36D for co-infusion, which is closed by a rubber plug 40, which is pierced by a infusion mixing needle (not shown) for executing the co-infusion. Thanks to such an integrated structure, a reduced number of parts as well as a simplified assembling process are obtained, resulting in a reduced cost.

Figure 8:
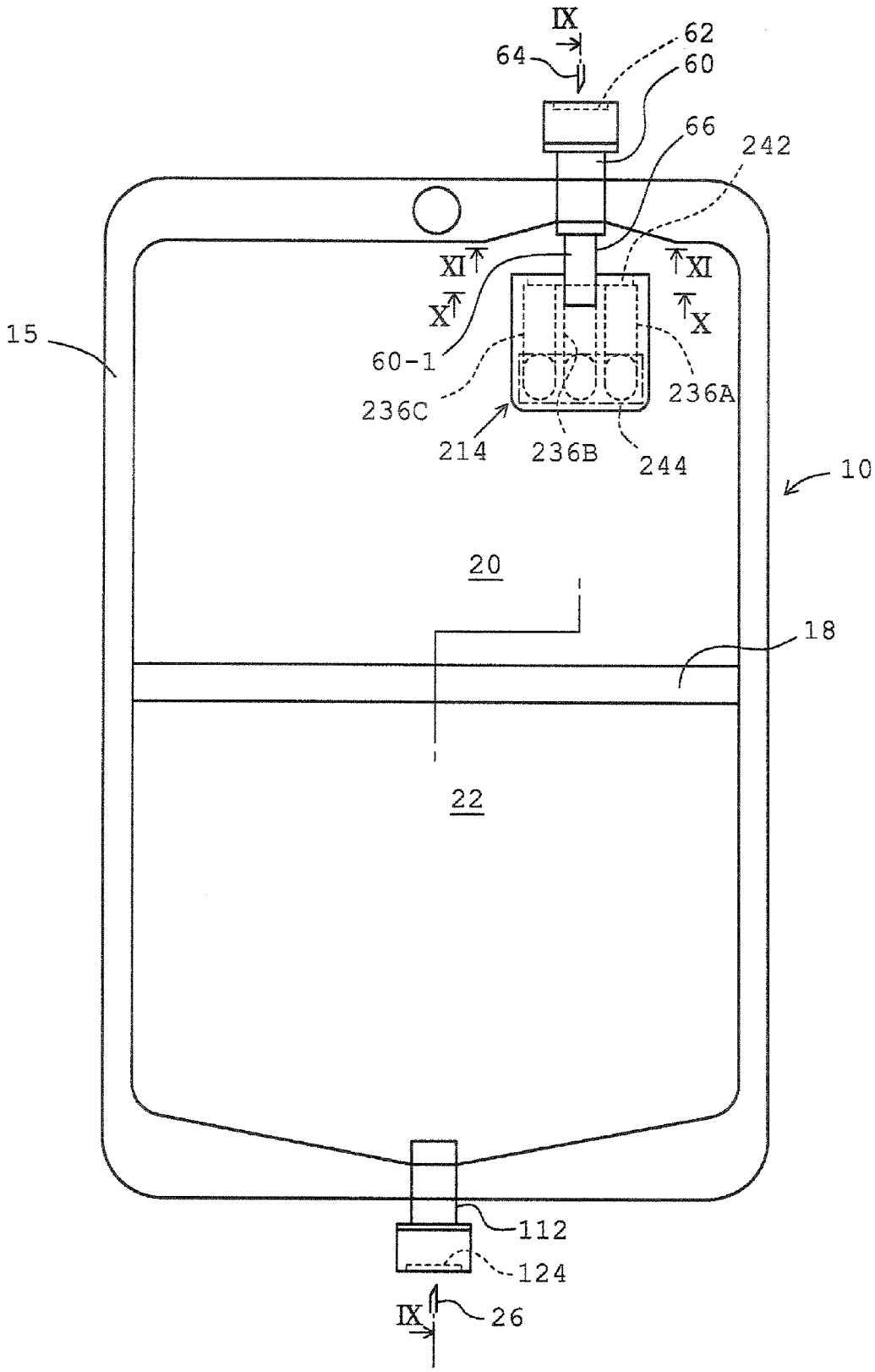
FIG. 8 is a plan view of another embodiment of a sealed medical storage of mixing type according to the present invention.

FIGS. 8 to 11 illustrates another embodiment of the present invention. This embodiment is an application of an idea of the present invention to a conventional type of a co-infusion port. Namely, in comparison with the first embodiment in FIG. 1, where the co-infusion port is integrated with the blending medicine inlet port 14, the second embodiment is provided with a co-infusion port 60 of an exclusive or an independent type at the top of the medical bag 10 as shown in FIG. 8. The co-infusion port 60 has a middle tubular part, which is, at its entire periphery, welded to the strong sealed portion 15. Prior to the commencement of the infusion operation, a needle 64 of an infusion set pierces a rubber plug 62, so that an infusion of a medical liquid different from the medical liquid in the medical bag is commenced. Thus, it will be understood that the co-infusion port 60 attains the same function as that of the compartment 36D (FIG. 1) in the first embodiment. The second embodiment features that a separate inlet port (small inner container for blending medicines) 214 is mounted to the end of the co-infusion port 60 located in the medical bag. Namely, the end of the co-infusion port 60 extends to the space inside the medical bag 10 for a predetermined length so that a pair of opposite and spaced cantilever fashioned parts 60-1 (FIG. 11) are formed. An inlet port 214 for the blending medicines is inserted or fitted the gap between the cantilever fashioned parts 60-1. A desirable engaging means such as a snap action type is provided between the parts 60-1, in order to prevent the inlet port 214 from being accidentally separated from the co-infusion port 60. As similar to the inlet port 14 in the first embodiment, the inlet port 214 of the second embodiment includes compartments 236A, 236B and 236C. The compartments have top ends adjacent the co-infusion port 60, which are permanently closed by a plug 242 and bottom ends adjacent the compartment 20, which are closed by peel film 244. As similar to the peel film 44 in the first embodiment, the peel film 244 is connected to the inlet port 214, at a degree of adherence, which allow the film to be peeled, on one hand and, on the other hand, holds the respective medicines in the compartments 236A, 236B and 236C under the non-opened condition of the medical bag. Contrary to this, the seal film 244 is strongly or non-peelably adhered to the portion 10" (FIG. 9) of the opposed surface of the medical bag 10. As will be clearly understood, the inner space 60' of the co-infusion port 60 is under a condition that the space is in communication with the inner space of the medical bag 10, i.e., the upper compartment 20 under the non-opened condition of the medical bag 10. Namely, as shown in FIG. 8, the insertion of the inlet port 214 to the recess between the cantilever fashioned parts 60-1 of the co-infusion port 60 is such that the recess is laterally opened at location adjacent the co-infusion port 60, which functions as a passageway 66 for obtaining a communication of the inner space 60' of the co-infusion port 60 with respect to the inner space of the medical bag 10. See also FIG. 11.

Figure 9:
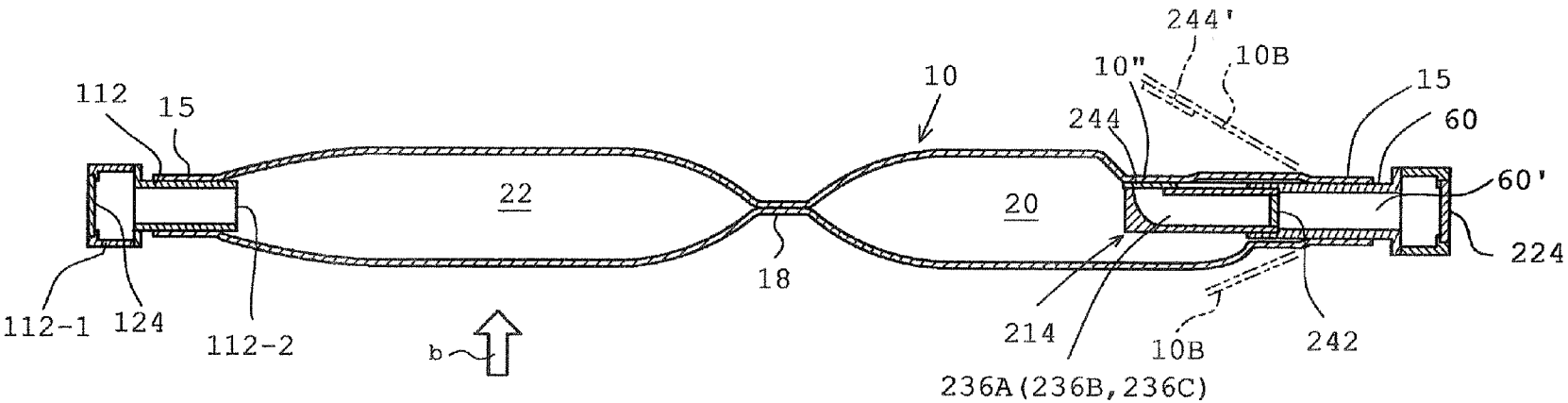
FIG. 9 is a vertical cross-sectional view of the sealed medical storage in FIG. 8 taken along the line IX-IX in FIG. 8.
Figure 10:
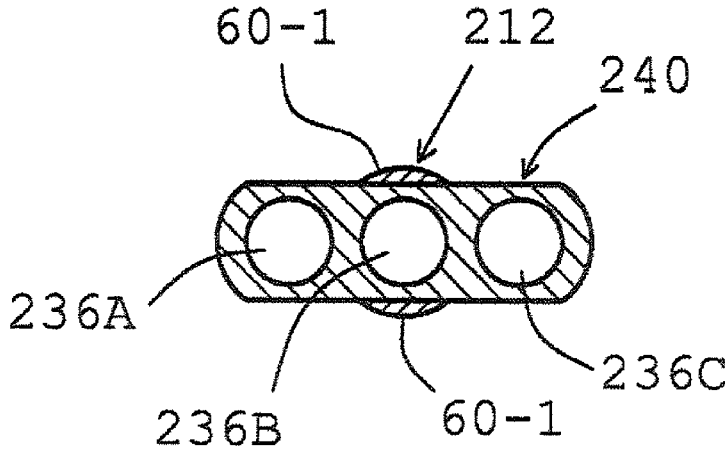
FIG. 10 is a cross-sectional taken along the line X-X in FIG. 8.
Figure 11:
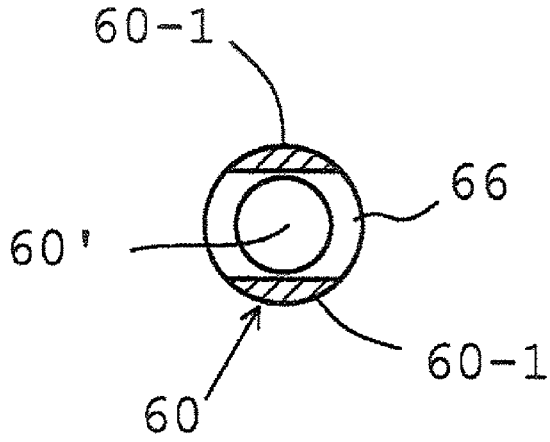
FIG. 11 is a cross-sectional taken along the line XI-XI in FIG. 8.

As shown in FIGS. 8 and 9, in order to effect an infusion operation, the outlet port 112 at the bottom of the medical bag is pierced by a needle 26 of an infusion set. Namely, the outlet port 112 is provided with a rubber plug 112 pierced by the needle 64 of an infusion set. In this second embodiment, the outlet port 112 is of a conventional type, wherein the medical bag 10 is, at its end adjacent the bag, always in communication with the space inside the bag. However, the outlet port 112 in FIGS. 8 and 9 may be provided with a construction, which is similar to that shown in FIGS. 1 and 2, where the seal film is provided, which is separated under the effect of hydraulic pressure upon the opening of the medical bag in a manner that a discharge from the outlet port is allowed.

An operation of the embodiment in FIGS. 8 to 12 is similar to that of the first embodiment. Namely, the weak seal 15 is opened by pressing the medical bag 10 as shown by an arrow b in FIG. 9, resulting in a generation of a rushing flow of liquid, which causes the medical bag to be widened as shown by phantom lines 10B at location where the medical bag is connected to the co-infusion port 60. As a result, the seal film 244 is separated or broken as shown by phantom lines 244' from the inlet port 214. Thus, the respective medical liquids in the compartments 236A, 236B and 236C are introduced into and mixed with the medial liquid in the bag 10. Thus, an advantageous effect as similar to that of the first embodiment is obtained that one shot operation is enough to obtain both the opening of the medical bag (mutual communication of the compartments 20 and 22) and the introduction of the blending medicines from the inlet port (small container) 214. In addition, in this second embodiment, in comparison with the first embodiment, the inlet 214 is located relatively away from the strong seal and, therefore, the additional medical liquids stored in the respective compartments 236A, 236B and 236C of the inlet body 214 are effectively protected from the high temperature as generated upon the formation of the strong seal portion 15. Furthermore, the medical bag 10 is connected to the peel film 244 at the location 10", which is largely spaced from the strong seal 15, so that a relatively increased degree of widening is obtained upon the opening of the medical bag, which is advantageous in that a more positive separation of the seal film 244 is obtained when the opening of the medical bag is done.

The invention claimed is:

1. A sealed medical storage comprising:

a medical bag made of a soft flexible material separated to a plurality of compartments for storing respective medicines under a sealed manner while being capable of communicated with each other;

an outlet port adjacent to one of said compartments and connected to the medical bag under a fluid tight manner, said outlet port has an inner end portion located inside the medical bag, said inner end portion having a plurality of circumferentially spaced communication holes covered by a peel member;

an inlet port adjacent to one of said compartments and connected to the medical bag under a fluid tight manner, said inlet port comprises at least one chamber for storing therein with respective blending medicine separately from medicines stored in the compartments, said inlet port being made of a material of rigidity, which is sufficient to maintain its own shape, said inlet port having an outer end portion for the fluid tight connection of the inlet port to the medical bag at an outer peripheral portion of the medical bag and an inner end portion located inside the medical bag, said inner end portion of the inlet port having an inlet opening for introduction of the medicine from the respective chamber to the space inside the bag, said inlet opening facing with a portion or an inner surface of the medical bag at a location spaced from the outer peripheral portion of the bag, said inlet port having a substantially flat side wall faced with the opposed inner surface of the medical bag, said inlet opening being opened at said side wall, and;

a peel member as a soft flexible film, which is adhered to said side wall of the inlet port to normally close said inlet port, so that the inlet port is normally closed with respect to the space inside the compartments of the medical bag, said peel film member being also adhered to said opposed inner surface of the medical bag at an adhesive strength larger than that of the peel member to the inlet port, so that an expanded deformation of the bag under a hydraulic force as generated when the separation between the compartments is opened causes the peel member to be separated from the inlet port, while the peel member being kept to be adhered to the inner surface of the medical bag.

2. The sealed medical storage according to claim 1, wherein said peel member is formed as a sheet of thermoplastic resin film of a single layer or multi layer structure, which sheet is firmly connected to the medical bag.

3. The sealed medical storage according to claim 2, wherein said thermoplastic resin film includes at least material of the same type as that of the soft flexible material forming the medical bag.

4. The sealed medical storage according to claim 2, wherein the thermoplastic resin film as a multi layer structure has an innermost and outermost layers made of resin materials of different values of melting temperature.

5. The sealed medical storage according to claim 2, wherein the thermoplastic resin film as a multi layer structure has an innermost thermoplastic resin film layer made of polyolefin resin of an increased melting temperature.

6. A sealed medical storage comprising:

a medical bag made of a soft flexible material, a weak seal for separating the medical bag into a plurality of compartments for storing respective medicines under a sealed manner;

an outlet port adjacent to one of said compartments and connected to the medical bag under a fluid tight manner, said outlet port has an inner end portion located inside the medical bag, said inner end portion having a plurality of circumferentially spaced communication holes covered by a peel member;

an inlet port adjacent to one of said compartments and connected to the medical bag under a fluid tight manner, said inlet port comprises at least one chamber for storing therein with respective blending blending medicine, said inlet port being made of a material of rigidity, which is sufficient to maintain its own shape, said inlet port having an outer end portion for the fluid tight connection of the inlet port to the medical bag at an outer peripheral portion of the medical bag and an inner end portion located inside the medical bag, said inner end portion of the inlet port having an inlet opening for introduction of the medicine from the respective chamber to the space inside the bag, said inlet opening facing with a portion or an inner surface of the medical bag at a location spaced from the outer peripheral portion of the bag, and;

a peel member adhered to said inlet port so as to close the inlet opening to the inside of the medical bag under a liquid tight manner, said peel member being adhered to the opposed surface of the medical bag at an adhesive strength which is larger than that of the peel member with respect to said inlet port said inlet port having a substantially flat side wall faced with the opposed inner surface of the medical bag, said inlet opening being opened at said side wall, and;

wherein said peel member is a soft flexible film, which is adhered to said side wall of the inlet port to normally close said inlet port, so that the inlet port is normally closed with respect to the space inside the compartments of the medical bag, said peel film member being also adhered to said opposed inner surface of the medical bag at an adhesive strength larger than that of the peel member to the inlet port, so that an expanded deformation of the bag under a hydraulic force as generated when the separation between the compartments is opened causes the peel member to be separated from the inlet port, while the peel member being kept to be adhered to the inner surface of the medical bag.

7. The sealed medical storage according to claim 6, wherein said inlet port is connected to the outer peripheral portion of the medical bag under a liquid tight manner.

8. The sealed medical storage according to claim 1, further comprising a peelable closure member, which closes the outlet port with the inner space of the medical bag, said closure member being integrally connected to the opposed surface of the medical bag.

9. The sealed medical storage according to claim 1, further comprising holder member made of the material of the same type as that of the soft material constructing the medial bag, said holder member being connected to the outer periphery of the medical bag under a liquid tight manner.

10. The sealed medical storage according to claim 1, further comprising a co-infusion port for an introduction of a different medicine, said co-infusion port being integral with said inlet port.

11. A sealed medical storage comprising:

a medical bag made of a soft flexible material separated to a plurality of compartments for storing respective medicines under a sealed manner while being capable of communicated with each other;

an outlet port adjacent to one of said compartments and connected to the medical bag under a fluid tight manner, said outlet port has an inner end portion located inside the medical bag, said inner end portion having a plurality of circumferentially spaced communication holes covered by a peel member;

a co-infusion port for introduction of a different medicine from this in the compartments, said co-infusion port being made of a material of rigidity sufficient to maintain its own shape, said co-infusion port being under a fluid tight connection to the medical bag at an outer peripheral portion of the medical bag and an inner end portion located inside the medical bag;

an inlet port comprising at least one chamber for storing therein with respective blending medicine separately from medicines stored in the compartments, said inlet port being made of a material of rigidity, which is sufficient to maintain its own shape, said inlet port having an inlet opening for introduction of the medicine from the respective chamber to the space inside the bag, said inlet opening facing with a portion of an inner surface of the medical bag at a location spaced from the outer peripheral portion of the bag; and;

a closure member of said inlet opening, which closure member cooperates with said faced portion of the medical bag, by which the closure member of the inlet opening is normally closed with respect to the space inside the compartments of the medical bag, said closure member cooperating with an expanded deformation of the bag in a manner that the closed condition of the inlet port by the closure member is cancelled by a hydraulic force as generated when the separation between the compartments is opened, said inlet port being connected to said inner end of the co-infusion port inside the medical bag and said inlet port having a substantially flat side wall faced with the opposed inner surface of the medical bag, said inlet opening being opened at said side wall, and;

a peel member as a soft flexible film, which is adhered to said side wall of the inlet port to normally close said inlet port, so that the inlet port is normally closed with respect to the space inside the compartments of the medical bag, said peel film member being also adhered to said opposed inner surface of the medical bag at an adhesive strength larger than that of the peel member to the inlet port, so that an expanded deformation of the bag under a hydraulic force as generated when the separation between the compartments is opened causes the peel member to be separated from the inlet port, while the peel member being kept to be adhered to the inner surface of the medical bag.

12. The sealed medical storage according to claim 1, wherein said inlet port is formed with a plurality of chambers having respective inlet openings juxtaposed at said side wall of the inlet port as the rigid body, said juxtaposed inlet opening being commonly closed the peel member as a single sheet.

13. The sealed medical storage according to claim 6, wherein said inlet port is formed with a plurality of chambers having respective inlet openings juxtaposed at said side wall of the inlet port as the rigid body, said juxtaposed inlet opening being commonly closed the peel member as a single sheet.

14. The sealed medical storage according to claim 11, wherein said inlet port is formed with a plurality of chambers having respective inlet openings juxtaposed at said side wall of the inlet port as the rigid body, said juxtaposed inlet opening being commonly closed the peel member as a single sheet.

* * * * *